United States Patent [19]

Streifer et al.

[11] Patent Number: 4,862,802

[45] Date of Patent: Sep. 5, 1989

[54] METHOD OF INITIATING A SEQUENCE OF PYROTECHNIC EVENTS

[75] Inventors: William Streifer, Palo Alto; Donald R. Scifres, San Jose; Jerome R. Klein, Los Altos, all of Calif.

[73] Assignee: Spectra Diode Laboratories, Inc., San Jose, Calif.

[21] Appl. No.: 217,551

[22] Filed: Jul. 11, 1988

[51] Int. Cl.[4] ..... F42C 19/00

[52] U.S. Cl. ..... 102/201

[58] Field of Search ..... 102/201

[56] References Cited

U.S. PATENT DOCUMENTS

| | | | |
|---|---|---|---|
| 3,362,329 | 1/1968 | Epstein | 102/201 |
| 3,455,625 | 7/1969 | Brumley et al. | 350/96 |
| 3,620,166 | 11/1971 | Bratton et al. | 102/201 |
| 4,007,688 | 2/1977 | Franz | 102/49.5 |
| 4,327,963 | 5/1982 | Khoe et al. | 350/96.18 |
| 4,391,195 | 7/1983 | Shann | 102/201 |
| 4,455,941 | 6/1984 | Walker et al. | 102/201 |
| 4,730,198 | 3/1988 | Brown et al. | 350/96.20 |

*Primary Examiner*—Charles T. Jordan

*Attorney, Agent, or Firm*—Thomas Schneck

[57] ABSTRACT

A pyrotechnic ignition method in which a semiconductor laser bar or bars containing a number of independent laser array sources deliver optical power in a specified sequence through optical fibers to a set of pyrotechnic elements in order to initiate a sequence of pyrotechnic events, such as a fireworks display, building demolition, emergency ejection sequence, satellite launch, etc. A command signal is transmitted and received, typically by a remote station from the user. The signal is decoded to generate a set of electrical signals representing addresses of individual laser arrays on the laser bar. The laser arrays are activated in the desired sequence in response to the set of electrical signals and emit laser light. This light is transmitted along optical fibers coupled to the individual laser arrays and terminating in pyrotechnic elements. The pyrotechnic elements are ignited in response to optical power received from the optical fibers, typically by direct heating of a detonator. The detonator may also be ignited photochemically or by electric current produced by a photoelectric sensor in response to sensing of the laser light.

26 Claims, 2 Drawing Sheets

METHOD OF INITIATING A SEQUENCE OF PYROTECHNIC EVENTS

TECHNICAL FIELD

The present invention relates to methods for igniting pyrotechnic devices, and in particular to methods for initiating pyrotechnic ignitions in the proper sequence.

BACKGROUND ART

In many pyrotechnic applications, it is necessary or desirable to initiate a specified sequence of events, some of which might be simultaneous. For example, in a fireworks display it is necessary to ignite the many pyrotechnic rockets in a particular order and at a safe distance. In building demolition, a timed sequence of explosions is set off remotely in order to cause the building to collapse in a controlled manner with a minimum of damage to surrounding buildings. An emergency ejection from the cockpit of an airplane requires a first detonation of explosive bolts to separate the cockpit canopy from the plane followed milliseconds later by a second detonation of explosive devices under the pilot's seat to propel the pilot and seat out of the airplane. Once the seat is clear of the plane, a third pyrotechnic event may be required to deploy parachutes. When launching a satellite into orbit on top of a rocket, a sequence of pyrotechnic events is required to separate a rocket gantry and other linkages simultaneously from the rocket shortly after rocket ignition, to separate the various booster stages sequentially as their fuel is used up, and to deploy the satellite from the final stage.

In each instance, the pyrotechnic devices must be ignited in the correct order and with a high degree of reliability. If, for example, the explosives on one side of a building were to go off before those on the opposite side of the building, the building might fall to one side into the street or into an adjacent building, rather than collapsing into its own basement. If the pilot's seat were to be ejected from the airplane before the canopy was open, loss of life would be almost certain. It is also important that pyrotechnic events not be set off accidentally. Pyrotechnic devices are typically ignited using a large pulse of electrical energy to set off a chemical detonator It is important that small stray electrical sparks, radio frequency electrical fields or natural electrical discharges, such as lightning, do not set off the detonator.

An object of the present invention is to provide a method of initiating a sequence of pyrotechnic events in a controlled or programmed manner which is reliable and which minimizes the possibility that pyrotechnic devices would be set off accidentally or in the wrong order.

DISCLOSURE OF THE INVENTION

The above object has been met with a method which uses a semiconductor laser bar containing a number of independent laser sources to deliver high optical power through fibers to various locations in any specified sequence. The method comprises transmitting a command signal representing a particular sequence of pyrotechnic events which a user intends to take place, the signal including a command to initiate the pyrotechnic sequence. The command is received by a receiving station and sent via a line to a decoder, which converts the received command signal into a set of electrical signals in a specified sequence, representing addresses of individual laser arrays or sources on a semiconductor laser bar. The decoder may be a general purpose processor receiving a complex command signal representing programmed instructions, or may be logic dedicated to a particular sequence and receive a simple start signal. The set of electrical signals is transmitted down a data bus terminating at the laser bar, the individual lines of the bus connecting to contact pads of particular laser arrays or sources of the laser bar. Laser arrays receiving an electrical signal are activated in the specified sequence and emit light which is transmitted down optical fibers to responsive elements of a pyrotechnic system. Typically, the optical power ignites a detonator, for example, photo-chemically, photo-electrically, or thermally, which, in turn, initiates an explosion or other pyrotechnic event, the sequence of events being determined by the activation sequence of the individual laser sources or arrays, which in turn is determined by the set of electrical signals derived from the command signal.

BEST MODE FOR CARRYING OUT THE INVENTION

Figure 1:
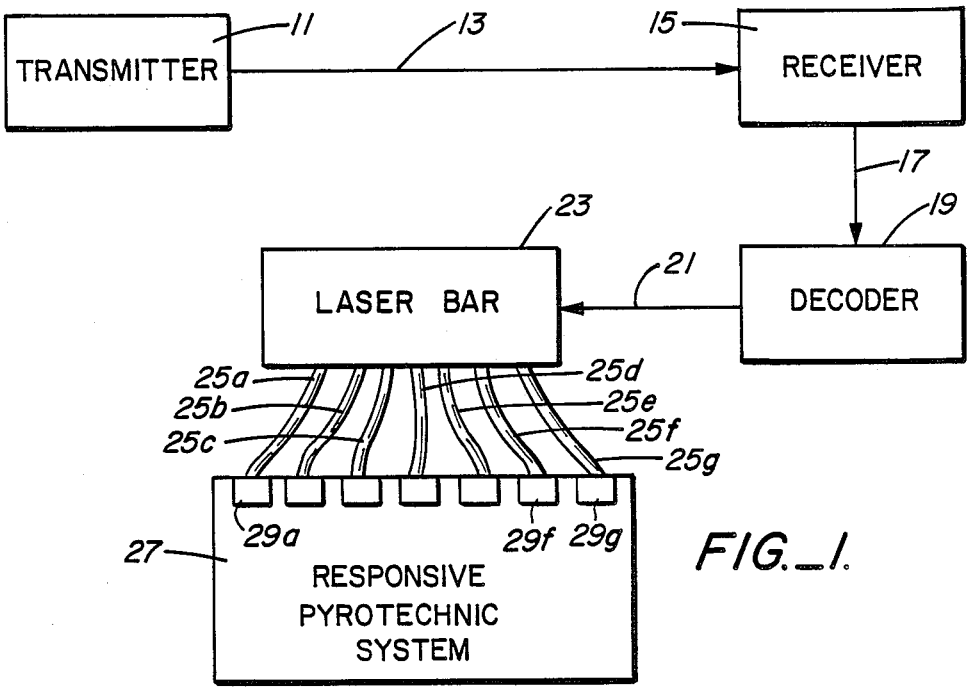
FIG. 1 is a schematic view of an optical sequencing system carrying out the pyrotechnic initiating method of the present invention.

With reference to FIG. 1, an optical sequencing system carrying out the method of the present invention comprises a transmitter 11 for sending command signals 13 from a user to a remote receiver 15. Command signals 13 may be transmitted down a dedicated line such as a wire, bus or optical fiber or may be broadcast as radio waves, microwaves, light, or other electromagnetic waves to an appropriate type of receiver 15. Signal 13 may be a simple "start" pulse or a complex code containing programmed instructions. Transmitter 11 allows the user to be located at a safe distance from the pyrotechnic events, as in a fireworks display or building demolition, or to communicate with the remainder of the system when the physical presence of the user is impossible, as where the user is on the ground near a satellite launch site and the rocket containing the receiver is traveling upwards into orbit. Alternatively, transmitter 11 may be optional or consist of a simple on/off switch for initiating an emergency ejection system in an airplane.

Receiver 15 communicates with a signal decoder 19 via one or more lines 17. Decoder 19 reads the command signals 13 received by receiver 15 and generates the appropriate set of electrical signals in the correct sequence, then transmits the signals along data bus 21 to a semiconductor laser bar 23. The laser bar 23 is patterned in such a way that it contains a number of independent laser sources. Each source is coupled to a separate fiber 25*a–g* and each source emits light if and only if it receives a suitable electrical signal or pulse from bus line 21.

Figure 2:
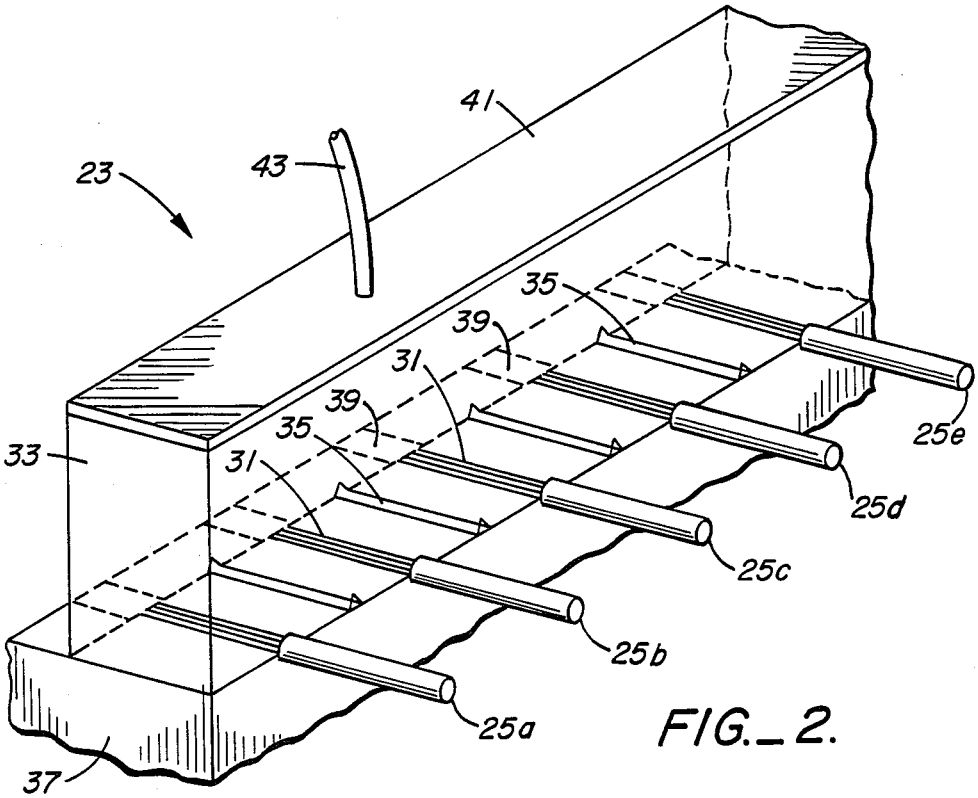
FIG. 2 is a perspective view of a portion of a laser bar of the system of FIG. 1.

For example, in FIG. 2, a laser bar 23 integrates a plurality of multistripe laser arrays 31 or sources on a single substrate 33. Each of these laser arrays 31 is coupled into an optical fiber 25*a,b*, etc. For operation as a sequencer, all or many of the laser arrays 31 are electrically isolated, as for example by etched notches 35 between the arrays 31. An electrically insulative, but thermally conductive heat sink 37, such as a BeO heat sink, is used. A metal stripe pattern is deposited on heat sink 37 and laser bar 23 is mounted on the heat sink. Contact pads 39, part of the metallization on heat sink 37, permit lines of bus 21 in FIG. 1 to electrically connect with the individual laser arrays 31 of laser bar 23. A common contact metallization 41 on substrate 33 of laser bar 23 also connects to a line 43 of bus 21. Note that multiple independent lasers not on a common mount could also be separately addressed.

One laser bar which may be used is a modified version of a commercially available laser from Spectra Diode Laboratories of San Jose, Calif., part No. 3480-L. This 1 cm long laser bar consists of twenty 10-stripe laser arrays, each 100 μm wide, on 500 μm centers. Each laser source could be made to be separately electrically addressed and be capable of a power output of greater than 100 mW cw per source and higher pulsed outputs. Each laser array could be coupled into an optical fiber with a circular cross-section of 100 μm diameter, a fiber with a rectangular cross-section, or alternatively, into a tapered fiber which changes from an elliptical cross-section end (100 μm long major axis) coupled to the laser arrays to a circular cross-section with 50 μm diameter output end, or to a flat "ribbon" fiber. The tapered or flat ribbon fibers yield a higher brightness at the output. Ways in which the laser bar and optical fibers may be coupled are described in U.S. Pat. No. 4,730,198 to Brown et al., and U.S. Pat. No. 4,327,963 to Khoe et al.

Referring again to FIG. 1, the output ends of optical fibers 25*a–g* communicate with an optically responsive pyrotechnic system 27. Pyrotechnic system 27 may comprise a plurality of elements 29*a–g* which need not be physically located in the same place, as for example, in a building detonation system made up of a plurality of strategically placed explosive devices situated throughout a building. Each optical fiber 25*a–g* connects to a particular pyrotechnic element 29*a–g* of the system 27, which element is represented in decoder 19 by a separate address from the other elements. The optical power emitted from a laser array of laser bar 23 and transmitted along an optical fiber 25 to element 29 is employed to ignite the pyrotechnic element 29, as for example, by heating an explosive detonator to its ignition temperature or by optically initiating a chemical reaction or by similar means. The optical fibers 25*a–g* can also deliver optical power to remote electronics, which in turn set off the pyrotechnic elements 29*a–g*.

In operation, each laser array 31 in bar 23 emits light if and only if it receives a suitable electrical signal or pulse from decoder 19 via bus 21 and its corresponding contact pad 39 and stripes. Laser arrays 31 are switched on and off in a specified order in order to initiate a sequence of pyrotechnic events. A feature of the invention is that since the individual laser arrays 31 on bar 23 usually will not operate simultaneously, it is possible to drive each laser array 31 sequentially to guide high powers without generating a large quantity of waste heat. This enables an integrated source such as laser bar 23 to be used with advantages of economy, space and reliability. In addition, adjacent laser arrays 31 need not be excited immediately after one another even if the system requires pulses to be emitted immediately after one another. The individual laser arrays may be driven in any order desired to optimize waste heat management, and the fibers 25*a–g* can be rearranged to supply the needed optical power in the correct sequence to the various locations 29*a–g* of the responsive pyrotechnic system 27. Moreover, depending on the system needs and the total waste heat generated, one can excite two or more, preferably nonadjacent, laser arrays of laser bar 23, simultaneously. More than one laser bar can also be used when the number of responsive elements in the pyrotechnic system 27 exceeds the number of laser arrays on a laser bar.

More than one source and fiber can be used to induce a single pyrotechnic event so as to provide redundancy. In such a case, multiple laser sources would be coupled via optical fibers to each pyrotechnic element, and would be activated in the desired sequence in sets of sources. Each set of laser sources would correspond to the particular pyrotechnic element to which those sources are coupled. In addition to providing redundancy in the event of electrical, laser diode or optical fiber failure, the multiple sources could also be used to supply more optical power to a pyrotechnic element.

The method of the present invention may further include verifying the ignition of the pyrotechnic elements. Since the pyrotechnic detonation produces an emission of light having an energy greater than the band-gap of the laser, and since the optical fiber, having one end coupled to the pyrotechnic element being detonated, transmit this light back toward the corresponding laser source, the laser source will generate a change in its electrical current flow in response to this light signal falling on the laser's p-n junction. This change in electric current flowing through the individual laser sources can be detected so as to verify ignition of the pyrotechnic element. This change in electric current will be generated whether the laser is in its off, on, or back-biased state, and is true for either single diode laser pyrotechnic events or for multiple laser bar arrays.

Figure 3:
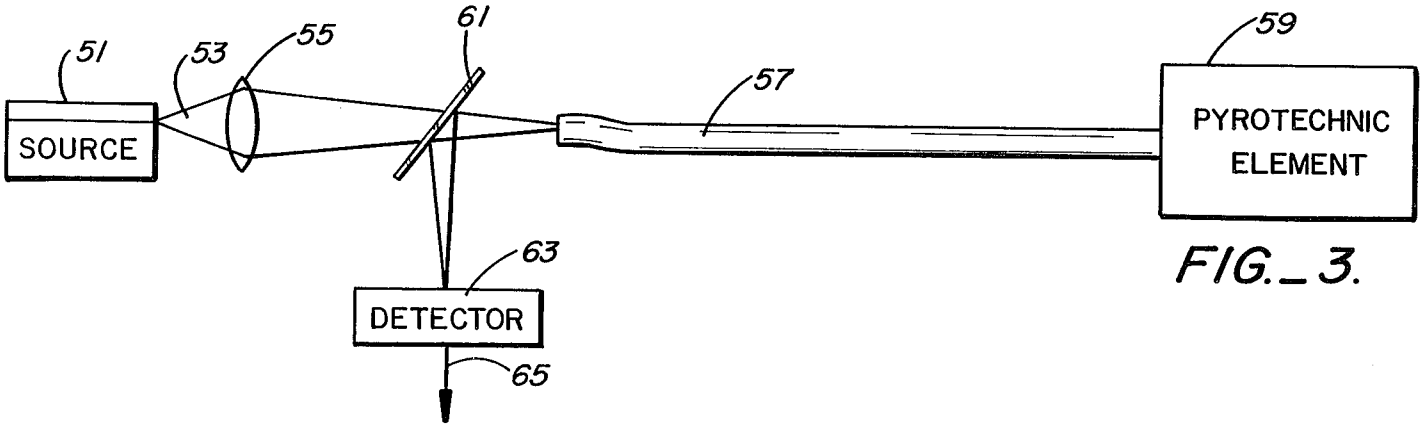
FIGS. 3 and 4 are diagrammatic views of a portion of the system of FIG. 1 illustrating alternative sensing arrangements for verifying pyrotechnic ignition in the method of the present invention.
Figure 4:
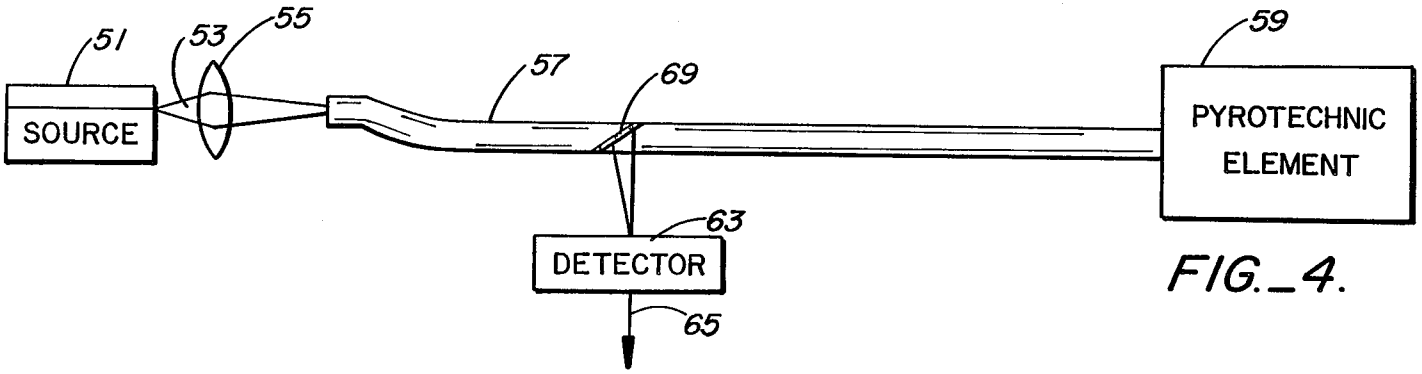

An alternative way to verify ignition involves the sensing of the light produced by ignition of a pyrotechnic element by means of a photodetector, the light being transmitted along the optical fiber to the photodetector. For example, in FIG. 3, a laser source 51 emits a laser beam 53 focused and directed by a lens and other optical elements 55 into an optical fiber 57. Optical fiber 57 transmits the optical energy of beam 53 to a pyrotechnic element 59, which then ignites. The light produced by the detonation of pyrotechnic element 59 is redirected back along optical fiber 57 to a partially reflective beamsplitter 61 which directs the light to a silicon detector 63. Detector 63 produces an electrical signal 65 which is sent to a conventional electronic sensing circuit, not shown. Alternatively, beamsplitter 61 may be replaced by a dichroic beamsplitter 69 that passes 800 nm laser light and deflects 500 nm light from the pyrotechnic event, as seen in FIG. 4.

Any of the methods of verifying ignition of the pyrotechnic elements can also be used to determine if the optical fibers and pyrotechnic elements are properly coupled. For example, in FIGS. 3 or 4, laser source 51 may emit a low power beam 55 which is transmitted along optical fiber 57 to pyrotechnic element 59. The power of beam 53 in this mode should be below the threshold of detonation so that premature ignition of pyrotechnic element 59 does not occur. As the optical fiber 57 is attached to pyrotechnic element 59 there will be a change in intensity and phase of the light reflected from the end of the optical fiber. Either or both of these parameters may be measured by detector 63, thereby enabling a user to determine when the fiber is properly attached to the pyrotechnic element 59. The test may be repeated for each of the fiber-pyrotechnic connectors.

The method of the present invention, using at least one laser bar with individually activated laser sources to optically trigger a sequence of pyrotechnic events minimizes the possibility that the events will be set off accidentally or in the wrong order since a large optical pulse if required for detonation and the laser bar is much more controllable than a pure electrical system.

We claim:

1. A method of initiating a sequence of pyrotechnic events comprising, receiving a command signal, said command signal representing a desired sequence of pyrotechnic events, generating and transmitting to at least one laser bar a set of electrical signals from said command signal, said electrical signals representing addresses of individual laser sources of said laser bar, said individual laser sources being activated in a desired sequence upon receiving said set of electrical signals, activated laser sources emitting laser light, transmitting said laser light along optical fibers coupled to said individual laser sources, said optical fibers terminating in a plurality of pyrotechnic elements, and igniting said pyrotechnic elements in said desired sequence, said laser light having sufficient optical power to cause said ignition of a pyrotechnic element when the corresponding laser source is active.

2. The method of claim 1 further defined by transmitting said command signal to a remote receiving station, said remote station receiving said command signal and sending said command signal to a decoder for generating said set of electrical signals.

3. The method of claim 1 wherein said laser bar comprises a plurality of individual laser sources which have been electrically isolated from adjacent laser sources of said bar so as to operate independently from one another.

4. The method of claim 1 wherein said optical fibers have a circular cross-section.

5. The method of claim 1 wherein said optical fibers have an elliptical cross-section at an end coupled to said laser bar, said elliptical cross-section characterized by a major axis at least as long as an individual laser source of said laser bar, said optical fiber tapering to a circular cross-section at an output end with a diameter smaller than said major axis.

6. The method of claim 1 wherein said optical fibers have a rectangular cross-section.

7. The method of claim 1 wherein igniting said pyrotechnic elements is accomplished directly by heating of a detonator associated with said pyrotechnic elements by said laser light, the optical power of said laser light being sufficient to cause detonation.

8. The method of claim 1 wherein igniting said pyrotechnic elements comprises sensing said laser light emitted from said termination of said optical fibers with a photoelectric sensor and generating an electrical current in response thereto, said electrical current setting off a detonator associated with said pyrotechnic elements, the optical power of said laser light being sufficient to generate a current strong enough to cause detonation.

9. The method of claim 1 wherein igniting said pyrotechnic elements is accomplished by the optical photons from said optical fibers directly initiating a chemical reaction in said pyrotechnic elements.

10. The method of claim 1 further comprising verifying ignition of said pyrotechnic elements.

11. The method of claim 10 wherein verifying ignition comprises detecting a change in electric current flowing through said individual laser sources, ignition of a pyrotechnic element producing an emission of light which is transmitted along an optical fiber to a corresponding laser source, said laser source producing said change in electric current when said light from said ignition is incident thereon.

12. The method of claim 10 wherein verifying ignition comprises sensing light produced by ignition of a pyrotechnic element by means of a photodetector, said light being transmitted along an optical fiber to said photodetector.

13. The method of claim 1 wherein multiple laser sources are coupled via optical fibers to each pyrotechnic element, said laser sources being activated in said desired sequence in sets of laser source corresponding to each of said pyrotechnic elements.

14. The method of claim 1 further comprising, prior to receiving said command signal, attaching said optical fibers to said plurality of pyrotechnic elements, transmitting low power laser light along said optical fiber and sensing a change in reflected light as said optical fibers are attached, said change indicating proper coupling of said optical fibers to said pyrotechnic elements.

15. A method of initiating a sequence of pyrotechnic events comprising, transmitting a command signal to a remote receiving station, said command signal representing a desired sequence of pyrotechnic events, receiving said command signal by said remote station, and delivering said command signal to a decoder, generating a set of electrical signals from said command signal by said decoder and transmitting said set of electrical signals to at least one laser bar, said electrical signals representing addresses of individual laser arrays of said laser bar, said laser arrays being electrically isolated from adjacent laser arrays on said bar so as to operate independently from one another, said laser arrays being activated in a desired sequence upon receiving said set of electrical signals, activated laser arrays emitting laser light, transmitting said laser light along optical fibers coupled to said individual laser arrays, said optical fibers terminating in a plurality of pyrotechnic elements, and igniting said pyrotechnic elements in said desired sequence, said laser light having sufficient optical power to cause said ignition of a particular pyrotechnic element when the corresponding laser array is activated.

16. The method of claim 15 wherein said optical fibers have a circular cross-section.

17. The method of claim 15 wherein said optical fibers have an elliptical cross-section at an end coupled to said laser bar, said elliptical cross-section characterized by a major axis at least as long as an individual laser array of said laser bar, said optical fiber tapering to a circular cross-section at an output end with a diameter smaller than said major axis.

18. The method of claim 15 wherein said optical fibers have a rectangular cross-section.

19. The method of claim 15 wherein igniting said pyrotechnic elements is accomplished directly by heating of a detonator associated with said pyrotechnic elements by said laser light, the optical power of said laser light being sufficient to cause detonation.

20. The method of claim 15 wherein igniting said pyrotechnic elements is accomplished by the optical photons from said optical fibers directly initiating a chemical reaction in said pyrotechnic elements.

21. The method of claim 15 wherein igniting said pyrotechnic elements comprises sensing said laser light emitted from said termination of said optical fibers with a photoelectric sensor and generating an electrical current in response thereto, said electrical current setting off a detonator associated with said pyrotechnic elements, the optical power of said laser light being sufficient to generate a current strong enough to cause detonation.

22. The method of claim 15 further comprising verifying ignition of said pyrotechnic elements.

23. The method of claim 22 wherein verifying ignition comprises detecting a change in electric current flowing through said laser arrays, ignition of a pyrotechnic element producing an emission of light which is transmitted along an optical fiber to a corresponding laser array, said laser array producing said change in electric current when said light from said ignition is incident thereon.

24. The method of claim 22 wherein verifying ignition comprises sensing light produced by ignition of a pyrotechnic element by means of a photodetector, said light being transmitted along an optical fiber to said photodetector.

25. The method of claim 15 wherein multiple laser arrays are coupled via optical fibers to each pyrotechnic element, said laser arrays being activated in said desired sequence in sets of laser arrays corresponding to each of said pyrotechnic elements.

26. The method of claim 15 further comprising, prior to transmitting said command signal, attaching said optical fibers to said plurality of pyrotechnic elements, transmitting low power laser light along said optical fibers and sensing a change in reflected light as said optical fibers are attached, said change indicating proper coupling of said optical fibers to said pyrotechnic elements

* * * * *